US006000379A

United States Patent [19]

Stockner et al.

[11] Patent Number: 6,000,379

[45] Date of Patent: Dec. 14, 1999

[54] ELECTRONIC FUEL INJECTION QUIET OPERATION

[75] Inventors: Alan R. Stockner; William J. Rodier, both of Metamora, Ill.

[73] Assignee: Caterpillar Inc., Peoria, Ill.

[21] Appl. No.: 08/978,229

[22] Filed: Nov. 25, 1997

[51] Int. Cl.[6] ..... F02M 7/00

[52] U.S. Cl. ..... 123/446; 123/458; 123/467; 251/129.18

[58] Field of Search ..... 123/446, 458, 123/467, 447; 251/129.01, 129.15, 129.18

[56] References Cited

U.S. PATENT DOCUMENTS

| | | | |
|---|---|---|---|
| Re. 35,079 | 11/1995 | Sverdlin | 123/467 |
| 3,827,409 | 8/1974 | O'Neill | 123/32 EA |
| 4,539,956 | 9/1985 | Hengel et al. | 123/357 |
| 4,619,239 | 10/1986 | Wallenfang | 123/458 |
| 4,785,987 | 11/1988 | Riszk | 123/458 |
| 5,092,301 | 3/1992 | Ostdiek | 123/480 |
| 5,125,807 | 6/1992 | Kohler | 123/458 |
| 5,174,262 | 12/1992 | Staerzl | 123/458 |
| 5,181,494 | 1/1993 | Ausman et al. | 123/446 |
| 5,280,773 | 1/1994 | Hendkel | 123/467 |
| 5,341,787 | 8/1994 | Zabeck | 123/458 |
| 5,357,912 | 10/1994 | Barnes et al. | 123/357 |
| 5,357,929 | 10/1994 | McCandless | 123/458 |
| 5,413,082 | 5/1995 | Cook et al. | 123/520 |
| 5,477,828 | 12/1995 | Barnes | 123/446 |
| 5,485,820 | 1/1996 | Iwaszkiewicz | 123/458 |
| 5,727,515 | 3/1998 | Biester | 123/458 |

FOREIGN PATENT DOCUMENTS

| | | | |
|---|---|---|---|
| 2312714 | 11/1997 | United Kingdom | F02D 41/40 |

*Primary Examiner*—Carl S. Miller
*Attorney, Agent, or Firm*—Robert J. Hampsch

[57] ABSTRACT

A method of controlling hydraulically actuated electrically controlled unit fuel injectors to operate quietly and with less seat wear on a valve disposed therein is disclosed. The disclosed method comprises controlling the pressure of a high pressure working fluid which operates the injector to inject the proper amount of fuel in the cylinders of an internal combustion engine; and responding to changes in the pressure of the working fluid to vary the timing duration and amplitude of a current pulse which activates a stator that draws an armature to the stator and opens a first seat of the poppet valve or other flow regulating device against a spring bias to allow the high pressure working fluid into the injector and closes a second seat to prevent the working from draining from the injector to allow the working fluid to operate the injector. Upon deactivation of the stator the spring bias moves the armature away from the stator, closes the first seat and opens the second seat of the poppet valve in a manner that reduces noise and wear on the seats.

11 Claims, 4 Drawing Sheets

ELECTRONIC FUEL INJECTION QUIET OPERATION

TECHNICAL FIELD

The invention relates to an internal combustion engine having an electronic fuel injection system and more particularly to an electronic fuel injection system, which operates quietly.

BACKGROUND ART

Electronic valves controlling fuel or oil in high pressure injections systems such a described in U.S. Pat. No. 5,181,494 requires fuel injectors which operate at high velocity and high pressure to properly meter and inject fuel into the cylinders of internal combustion engines. At idle speed and at light loads lower fuel flow and operating pressure may result in excess valve velocity producing noise and excessive valve seat wear.

DISCLOSURE OF THE INVENTION

The present invention may be characterized as a method of operating electronic fuel injectors quietly and with less valve seat wear at all operating conditions. In general, a method of controlling hydraulically actuated electronically controlled unit fuel injectors having a stator, an armature and a poppet valve or other flow regulating device. The poppet valve or other flow regulating device is connected to the armature and has first and second seats. When electrically activated the stator draws the armature to the stator and operates the valve to open the first valve seat to allow high pressure working fluid to operate an intensifier piston disposed within the injector. The intensifier piston intensifies or greatly increases the pressure of the fuel feed into the injector and injects the highly pressurized fuel into an associated cylinder of an internal combustion engine. The second valve seat is closed, shutting off the flow of working fluid from the injector to a drain. The method when performed in accordance with this invention, comprises the following steps: (a) controlling the amount of fuel injected into the associated cylinder by regulating the pressure of the working fluid; (b) generating an electrical pulse to activate the stator to move the armature and valve to inject fuel into the associated cylinder; and (c) varying the timing, duration and amplitude of the pulse in response to changes in working fluid pressure to reduce noise and wear at idle, light load and normal load operation of the engine.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

BEST MODE FOR CARRYING OUT THE INVENTION

Figure 1:
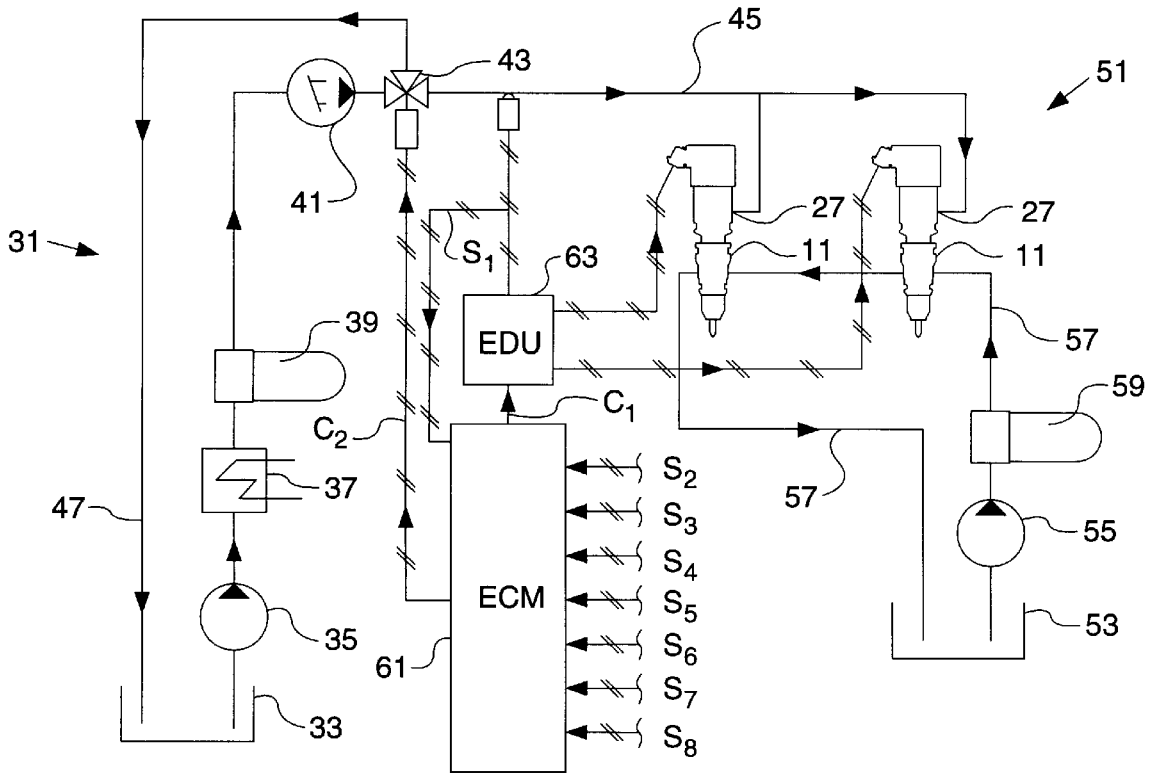
FIG. 1 is a schematic view of a control system for a hydraulically actuated electrically controlled unit injection fuel system.

Referring now to the drawings in detail and in particular to FIG. 1, there is shown a control system for a hydraulically actuated electrically controlled unit fuel injector 11 for an internal combustion engine (not shown).

Figure 2:
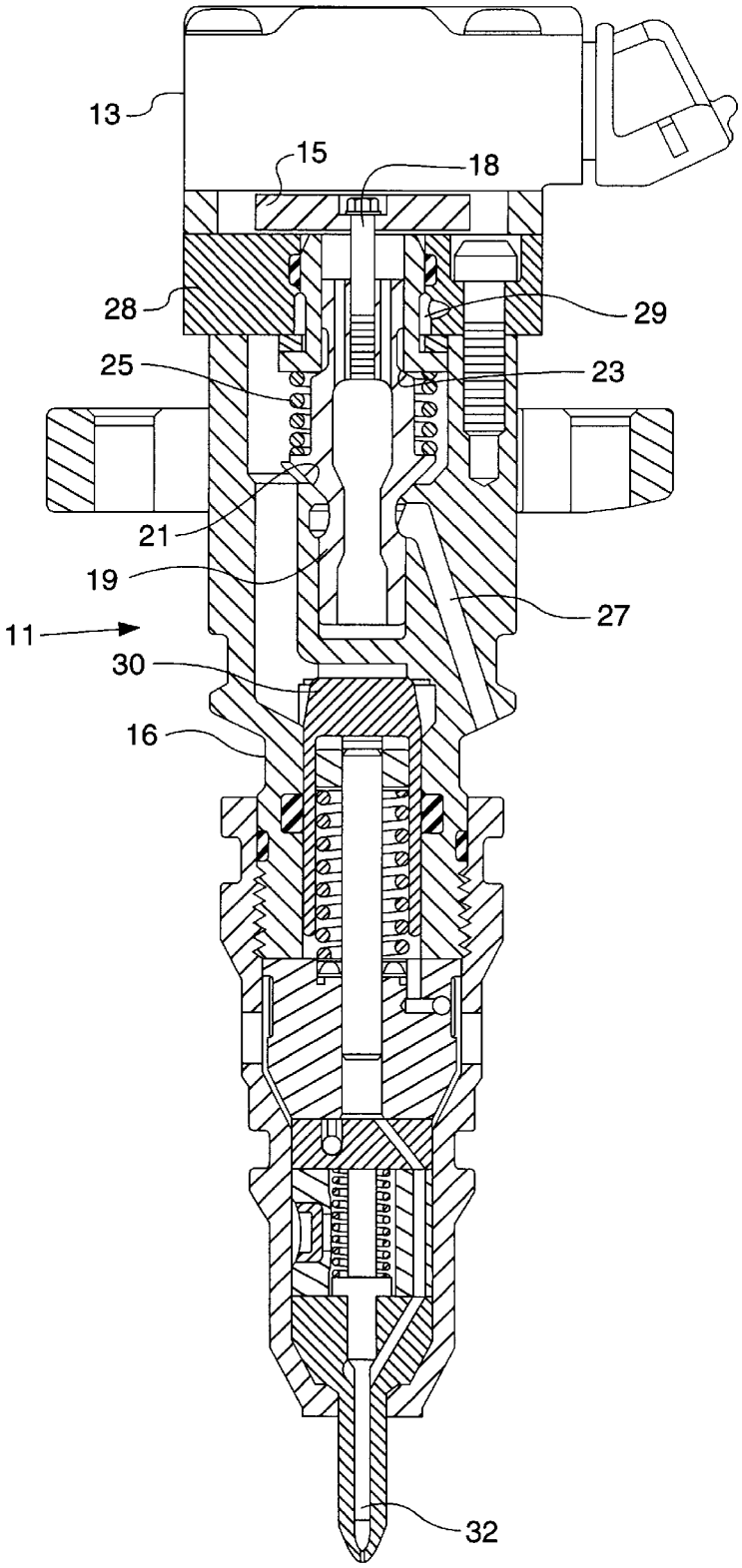
FIG. 2 is sectional view of a hydraulically actuated electrically controlled unit fuel injector.
Figure 3:
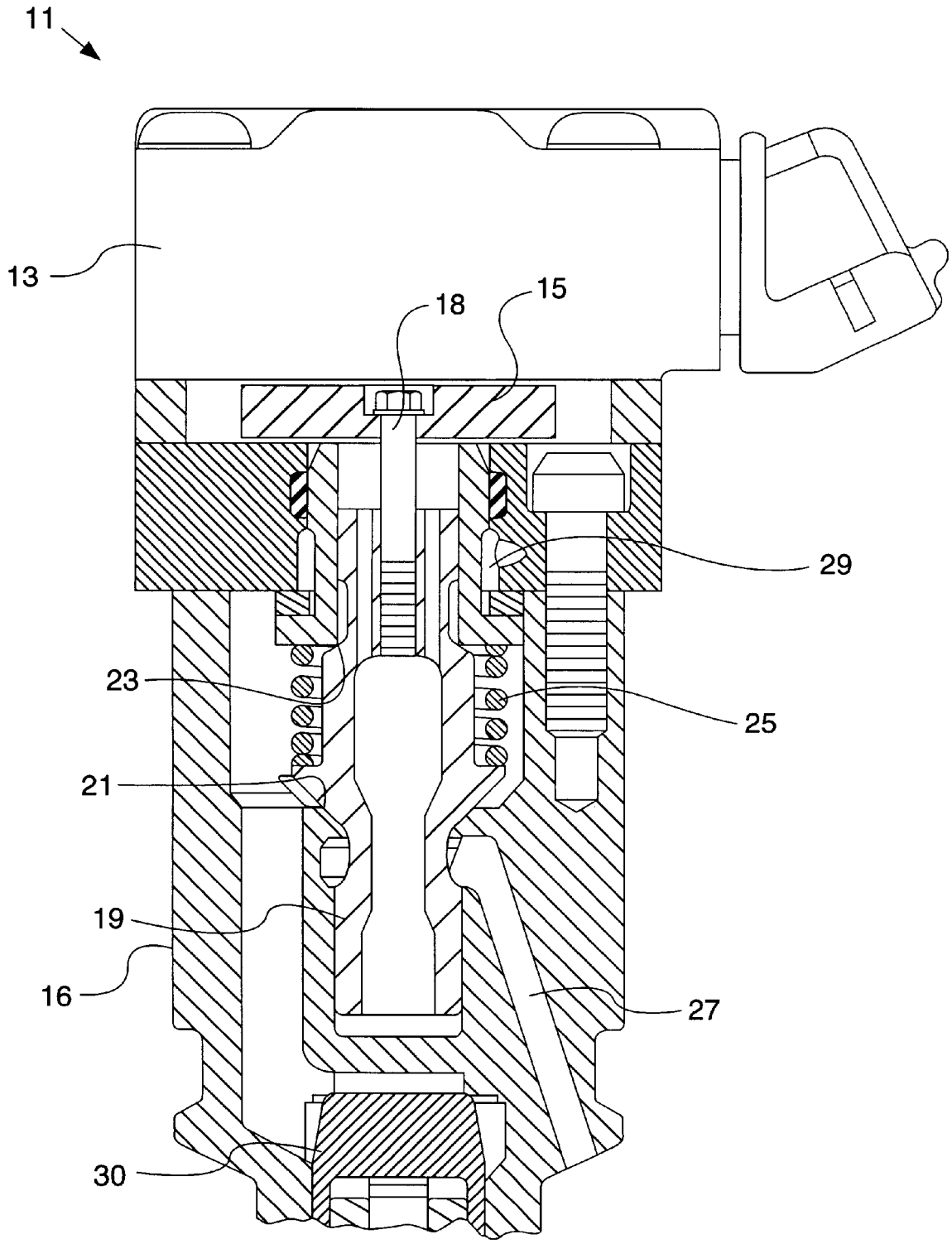
FIG. 3 is an enlarged partial sectional view of the upper portion of a hydraulically actuated electrically controlled unit fuel injector.

The fuel injector 11 as shown in FIGS. 2 and 3 comprises a stator 13 and armature 15 disposed at the upper end of an elongated tubular housing 16. The stator 13 has conductive coils (not shown) disposed therein to form an electromagnet which when energized draws the armature 15 to the stator 13. A bolt 18 connects the armature 15 to a poppet valve 19 or other flow regulating device disposed within the housing 16. The poppet valve 19 comprises a first or lower seat 21 and a second or upper seat 23. A coil spring 25 or other biasing means biases the poppet valve 19 downwardly seating the first seat and closing off a high pressure working fluid inlet port 27. The second or upper seat 23 is not seated, thus opening an upper interior portion 28 of the tubular housing 16 to a drain port 29 to drain excess working fluid therefrom. When the stator 13 is energized, the armature 15 is drawn to the stator 13, compressing the spring 25, moving the poppet valve 19 off the lower seat 21 and seating the upper seat 23 shutting off the flow of working fluid to the drain port 29 and allowing the high pressure working fluid to enter the tubular housing 16 and operate an intensifier piston 30. The intensifier piston 30 pressurizes the fuel to substantially higher pressure than the high pressure working fluid. The highly pressurized fuel operates a needle valve 32 allowing the highly pressurized fuel to be injected into the cylinder (not shown). For a more complete description of the hydraulically actuated electrically controlled unit fuel injector 11 and it operation reference may be made to U.S. Pat. No. 5,181,494 by Ausman et al. entitled "Hydraulically Actuated Electrically-Controlled Unit Injector" issued Jan. 26, 1993, which is hereby incorporated herein by reference.

Referring again to FIG. 1, there is shown two fuel injectors 1, however, it is understood that there may be any number depending on the size of the engine and the number of cylinders. A working fluid supply system 31 is shown supplying the high pressure working fluid to the working fluid inlet port 27. The drain port 29 relieves the pressure within the tubular housing 16 by draining the working fluid back to the crankcase through passages in the engine block (not shown) as lubricating oil is the preferred working fluid. The working fluid supply system 31 comprises an oil reservoir or crankcase 33, a low pressure pump 35 which pumps the oil through an oil cooler 37 and an oil filter 39 to a high pressure pump 41. The high pressure pump 41 pumps high pressure lubricating oil or working fluid through a pressure regulator 43 and a working fluid supply conduit 45 to the working fluid inlet ports 27 in the fuel injectors 1. A working fluid return conduit 47 returns working fluid from the pressure regulator 43 to the reservoir 33.

A fuel supply system 51 is shown to comprise a fuel tank 53, a fuel pump 55 which pumps the fuel via a fuel conduit 57 through a fuel filter 59 to the injectors 1 and then returns the unused fuel to the fuel tank 53.

An electronic control module 61 often referred to by it acronym ECM receives a plurality of input signals comprising a high pressure working fluid pressure signal S1, an engine speed signal S2, an inlet manifold pressure signal S3, an exhaust manifold pressure signal S4, an engine coolant temperature signal S5, an engine crankshaft position signal S6, a throttle or desired fuel setting signal S7, and a transmission operating condition signal S8. The ECM 61 contains a plurality of maps in the form of tables of empirical data specific to the engine and the control apparatus and compares the input signals S1 through S8 to the maps to generate control signals comprising C1 and C2 that operate an electronic drive unit 63 and the pressure regulator valve 43 to reduce noise and poppet valve seat wear.

The electronic drive unit 63, often referred to by it acronym EDU, is a pulse generator which produces pulses of DC current that vary in timing, amplitude and duration. The EDU 63 contains maps or tables of empirical data specific to the engine, and compares the maps or tables to changes in pressure of the high pressure working fluid, S1 and the control signal C1 from the ECM 61 that comprises a signal that tells the EDU 63 which fuel injector should receive the next pulse and when to send the pulse. Utilizing the incoming signals S1 and C1 the EDU 63 generates a pulse having the proper timing, amplitude and duration to reduce noise and poppet valve seat wear.

Figure 4:
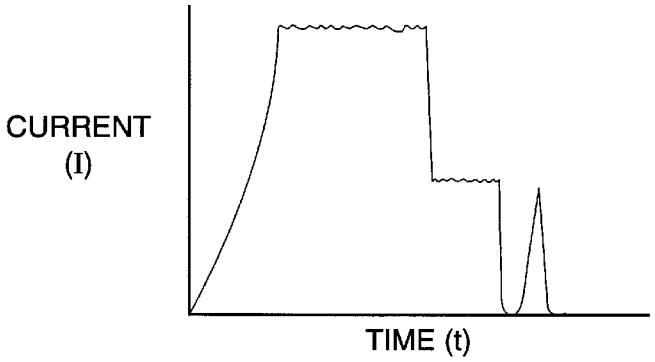
FIG. 4 shows a graph of amplitude of a current pulse verses time for normal engine loads.

FIG. 4 shows the amplitude of a pulse of current I verses time t for the pulse to activate the stator 13 when the engine is operating at normal speeds and loads. The current I rises rapidly to an amplitude which will quickly draw the armature 15 to the stator 13 and then drops rapidly to a level which will hold the armature 15 adjacent the stator 13. The current I is maintained at this amplitude for a time period sufficiently long to allow the injector 11 to inject the fuel into the cylinder. The current I then drops rapidly releasing the armature 15 and the spring 25 accelerates the poppet valve 19 toward the lower seat 21. Just before the lower seat 21 is seated, the current I is spiked. The amplitude or the current I rises rapidly to a value sufficient to slow down the armature 15 and poppet valve 19 and then drops rapidly. The energy produced by the spike slows down the armature 15 and the poppet valve 19 as the lower seat 21 is about to seat. This current spike reduces the impact on the lower seat 21 and thus the noise and wear caused by the seating impact. The duration of the pulse for normal operation of the engine is generally about 2 or 3 milliseconds, but may vary.

Figure 5:
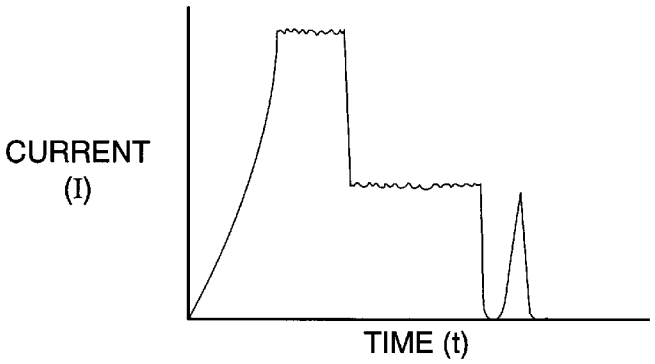
FIG. 5 shows a graph of amplitude of a current pulse verses time for idle and low engine loads.

FIG. 5 shows an amplitude of a pulse of current I verses time t for the pulse to activate the stator 13 when the engine is operating at idle speed or at low loads. The current I rises rapidly to an amplitude which will quickly draw the armature 15 to the stator 13, but for a shorter duration then shown in FIG. 4. The shorter duration reduces the energy the stator 13 applies to the armature 15 and the poppet valve 19. This reduces the velocity of the armature 15 and poppet valve 19 and the seating impact on the upper seat 23 and thus the noise and wear caused by the seating impact. At idle speed and at low loads the pressure of the working fluid is reduced causing less fuel to be injected into the cylinders. The working fluid dampens the armature 15 and poppet valve 19 however the amount of dampening is proportional to the pressure of the working fluid so dampening decreases with reduced working fluid pressure. The current I then drops rapidly to a level which will hold the armature 15 adjacent the stator 13. The current I is maintained at this amplitude for a time period sufficiently long to allow the injector 11 to inject the fuel into the cylinder. The current I then drops rapidly releasing the armature 15 and the spring 25 accelerates the armature 15 and poppet valve 19 toward the lower seat 21. Just before the lower seat 21 is seated the current I is spiked. The amplitude of the current I rises rapidly to a value sufficient to slow down the armature 15 and poppet valve 19 and then drops rapidly. The energy produced by the spike slows down the armature 3 and the poppet valve 19 as the lower seat 21 it is about to seat. This spike reduces the impact on the lower seat 21 and thus the noise and wear caused by the seating impact.

Figure 6:
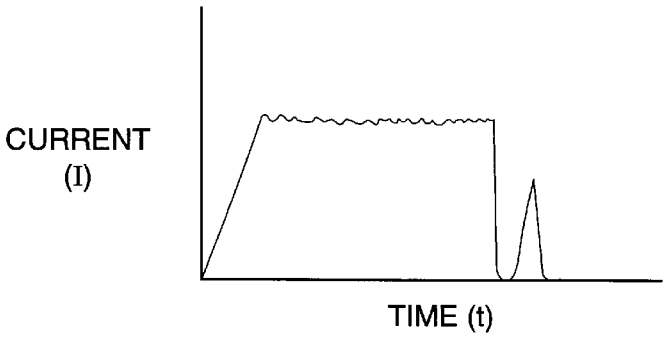
FIG. 6 shows a graph of an alternative amplitude of a current verses time for idle and low engine loads.

FIG. 6 shows an alternative amplitude of a pulse of current I verses time t for the pulse that activates the stator 13 when the engine is operating at idle speed and at low loads. The current I rises rapidly to an amplitude which will draw the armature 15 to the stator 13 and hold the armature 15 adjacent the stator 13. The current I is maintained at this amplitude for a time period sufficiently long to allow the injector 11 to inject the fuel into the cylinder. The current I then drops rapidly releasing the armature 15 and the spring 25 accelerates the armature 3 and the poppet valve 19 toward the lower seat 21. The amplitude of the current I is not as high as the amplitude in FIGS. 4 and 5 thus reducing the energy the stator 13 applies to the armature 15 and the poppet valve 19. This reduces the velocity of the armature 15 and poppet valve 19 and the seating impact on the upper seat 23 and thus the noise and wear caused by the seating impact. At idle speed and at low loads the pressure of the working fluid is reduced causing less fuel to be injected into the cylinders. The working fluid dampens the armature 15 and poppet valve 19 however the amount of dampening is proportional to the pressure of the working fluid. Just before the lower seat 21 is seated the current I is spiked. The amplitude of the current I rises rapidly to a value less than the current I spike in FIGS. 4 and 5 but the duration is longer. The energy produced by this spike slows down the armature 3 and the poppet valve 19 as the lower seat 21 it is about to seat. This spike reduces the impact on the lower seat 21 and thus the noise and wear caused by the seating impact.

A method of controlling hydraulically actuated electronically controlled unit fuel injector comprises three basic steps.

The first basic step involves controlling the amount of fuel injected into the associated cylinder by regulating the pressure of the working fluid. The working fluid operates an intensifier piston 30 within the injector 11 to greatly increase or intensify the pressure of the fuel fed to the injector 11. The intensified fuel pressure operates he needle valve 32 injecting the fuel into the associated cylinder at the intensified pressure.

The second basic step involves generating an electrical pulse to actuate the stator 13 and move the armature 15 and poppet valve 19 to allow the high pressure working fluid into the injector 11 to operate the injector 11 to inject fuel into the associated cylinder.

Finally, the third basic step involves varying the timing, duration, and amplitude of the pulse in response to changes in working fluid pressure to reduce noise and wear at idle, light load and normal load operation of the engine.

Varying the timing, duration, and amplitude of the pulse involves generating a pulse for normal load operation having two distinct steps. The first step having a current I that rises rapidly to an amplitude generally about 7.0 amps and remains at that amplitude for a sufficient time to activate the stator 13 and draw the armature 15 rapidly to the stator 13. The amplitude of the current I then drops rapidly to an amplitude of generally about 3.5 amps which is sufficient to hold the armature 15 adjacent the stator 13 and the first seat 21 of the poppet valve 19 open. The current I remains at that amplitude for a sufficient time to allow the injector 11 to inject the proper amount of fuel into the associated cylinder. The amplitude of the current I is then dropped rapidly, releasing the armature 15 from the stator 13. The spring 25 moves the poppet valve 19 rapidly toward seating the first or lower seat 21. Just before seating the first seat 21 a current spike is generated. The amplitude of the current I is raised rapidly to a level which will slow down the armature 15 and the poppet valve 19 and then rapidly dropped. Slowing down the armature 15 and the poppet valve 19 reduces the seating impact, thus reducing the noise and wear produced by the seating impact.

Similarly, varying the timing, duration and amplitude of the main electrical pulse also involves generating a pulse for idle and low load operation also having two distinct steps. The first step of idle and low load operation has a current I that rises rapidly to an amplitude generally about 7.0 amps and remains at that amplitude for a sufficient time to draw the armature 15 rapidly to the stator 13. The duration of this first step is substantially less than the duration of the first step for normal load operation about half the duration. Since the pressure or the working fluid is reduced, the damping effect of the working fluid on the armature 15 and poppet valve 19 is also reduced. Therefore to reduce the seating impact on the second seat 23 the magnetic force produced by the first step is reduced. The amplitude of the current I then drops rapidly to an amplitude of generally about 3.5 amps which is sufficient to hold the armature 15 adjacent the stator 13 and the first seat 21 of the poppet valve 19 open. The current I remains at that amplitude for a sufficient time to allow the injector 11 to inject the proper amount of fuel into the associated cylinder. The duration of sum of this first and second step in generally about the same duration as the sum of the duration of the first and second step pulse produced for normal load operation generally about 3.0 milliseconds. The amplitude of the current I is then dropped rapidly, releasing the armature 15 from the stator 13. The spring 25 moves the poppet valve 19 rapidly toward seating the first or lower seat 21. Just before seating the first seat 21 a current spike or secondary electrical pulse is generated. The amplitude of the current I is raised rapidly to a level which will slow down the armature 15 and poppet valve 19 and then rapidly dropped. Slowing down the poppet valve 19 reduces the seating impact and thus reducing the noise and wear produced by the seating impact.

Alternatively, one may vary the timing, duration, and amplitude of the main electrical pulse by generating a pulse for idle and low load operation comprises generating a pulse having a single step. The single step having a current I that rises rapidly to an amplitude generally about 4.0 amps and is sufficient to draw the armature 15 rapidly to the stator 13 and to hold the armature 15 adjacent the stator 13 and the first seat 21 of the poppet valve 19 open. The current I remains at this amplitude for a sufficient time to allow the injector 11 to inject the proper amount of fuel into the associated cylinder. The duration of this single step in generally about the same duration as the sum of the duration of the first and second step pulse produced for normal load operation or less. The amplitude of the single step is substantially less than the amplitude of the first step for normal load operation, since the pressure or the working fluid is reduced and the damping effect of the working fluid on the armature 15 and poppet valve 19 is also reduced. Therefore to reduce the seating impact on the second or upper seat 23 the magnetic force produced by this single step is reduced. The amplitude of the current I is then dropped rapidly, releasing the armature 15 from the stator 13. The spring 25 moves the armature 15 and the poppet valve 19 rapidly toward seating the first or lower seat 21. Just before seating the first seat 21 a current spike or secondary electrical pulse is generated. The amplitude of the current I is raised rapidly to a level which will slow down the armature 15 and the poppet valve 19. The amplitude is not as great as that shown in FIGS. 4 and 5 but the duration is greater providing sufficient energy to slow down the armature 15 and poppet valve 19. Slowing down the armature 15 and the poppet valve 19 reduces the seating impact and thus reducing the noise and wear produced by the seating impact.

While the preferred embodiments described herein set forth the best mode to practice this invention presently contemplated by the inventors, numerous modifications and adaptations of this invention will be apparent to others of ordinary skill in the art. Therefore, the embodiments are to be considered as illustrative and exemplary and it is understood that the claims are intended to cover such modifications and adaptations as they are considered to be within the spirit and scope of this invention.

INDUSTRIAL APPLICABILITY

The method of controlling hydraulically actuated electrically controlled unit fuel injectors as described herein advantageously reduces noise and wear on seats 21 and 23 of the poppet valve 19 and the mating seats within the housing 16 when operating at normal load, at idle speed and at light loads extending their life to reduce maintenance and failures during operation. The injectors also operate quietly at idle and under light loads when the noise from the popper valve 19 is most noticeable.

What is claimed is:

1. A method of controlling hydraulically actuated electronically controlled unit fuel injector having a stator, an armature and a flow regulating device with a first and second seat and connected to the armature, the stator, when electrically actuated, draws the armature to the stator and operates the flow regulating device to open a first valve seat to allow working fluid to operate an intensifier piston, which intensifies the pressure of fuel fed to the injector and injects the fuel into an associated cylinder of an internal combustion engine and closes a second valve seat, which when open allows working fluid to drain from the fuel injector, the method comprising the steps of:

controlling the amount of fuel injected into the associated cylinder by regulating the pressure of the working fluid;

generating an electrical pulse to actuate the stator and move the armature and allow the flow regulating device to inject fuel into the associated cylinder;

varying the timing, duration, and amplitude of the pulse in response to changes in working fluid pressure to reduce noise and wear at idle, light load and normal load operation of the engine.

2. The method of controlling hydraulically actuated electrically controlled unit fuel injectors as set forth in claim 1, wherein the step of varying the timing, duration and amplitude of the pulse, comprises utilizing tables of empirical data specific to the injectors and engine to control a electronic drive unit to generate DC current pulses which vary with respect to timing, duration and amplitude in response to changes in pressure of the working fluid.

3. The method of controlling hydraulically actuated electrically controlled unit fuel injectors as set forth in claim 1, wherein the step of varying the timing, duration and amplitude of the pulse, comprises generating a pulse for normal operation with two steps, the first step having a current of sufficient amplitude and duration to draw the armature rapidly to the stator and to operate the flow regulating device and a second step having a current lower in amplitude than the current of the first step and of sufficient amplitude to hold the armature adjacent the stator and the first seat of the flow regulating device open and having a duration sufficient to allow the injector to inject the proper amount of fuel into the associated cylinder;

generating a pulse for idle and low load operation with two steps, the first step being about the same amplitude as the first step in the normal operation pulse but having a shorter duration and a second step being about the same amplitude as the second step of the normal operation pulse and having a duration sufficient to hold the armature adjacent the stator and the first seat of the flow regulating device open to allow the injector to inject the proper amount of fuel into the associated cylinder, whereby the seating velocity and impact on the second seat of the flow regulating device is reduced reducing the seating noise and wear on the second seat.

4. The method of controlling hydraulically actuated electrically controlled unit fuel injectors as set forth in claim 3, wherein the step of varying the timing duration and amplitude of the pulse comprises generating a spike having a short duration and a current amplitude sufficient to slow down the armature and flow regulating device just before seating the first seat, the spike being timed after the second step, whereby the seating velocity and impact on the first seat is reduced, reducing noise and wear on the first seat.

5. The method of controlling hydraulically actuated electrically controlled unit fuel injectors controlling the amount of fuel injected into the associated cylinder by regulating the working fluid pressure as set forth in claim 1, wherein the step of varying the timing, duration and amplitude of the pulse, comprises generating a pulse for normal operation with two steps, the first step having a current of sufficient amplitude and duration to draw the armature rapidly to the stator and to operate the flow regulating device and a second step having a current lower in amplitude then the current of the first step and of sufficient amplitude to hold the armature adjacent the stator and the first seat of the flow regulating device open and having a duration sufficient to allow the injector to inject the proper amount of fuel into the associated cylinder;

generating a pulse for idle and low load operation with one step, the step having an amplitude substantially less than the amplitude of the first step in the normal operation pulse and the duration of the step is about the same as the combined duration of the first and the second step of the normal operation pulse, whereby the seating force on the upper seat of the flow regulating device is reduced reducing the seating noise and wear on the seat.

6. The method of controlling hydraulically actuated electrically controlled unit fuel injectors as set forth in claim 5, wherein the step of varying the timing, duration and amplitude of the pulse comprises generating a spike having a short duration and a current amplitude and duration sufficient to slow down the armature and flow regulating device just before it seats on the first seat the spike being timed after the pulse, whereby the velocity just before seating and the impact on the first seat are reduced, reducing noise and wear on the first seat.

7. The method of controlling hydraulically actuated electrically controlled unit fuel injectors as set forth in claim 2, wherein the step of varying the timing, duration and amplitude of the pulse, comprises:

generating a pulse for normal operation with two steps, the first step having a current of sufficient amplitude and duration to draw the armature rapidly to the stator and to operate the flow regulating device and a second step having a current lower in amplitude then the current of the first step and of sufficient amplitude to hold the armature adjacent the stator and the first seat of the flow regulating device open and having a duration sufficient to allow the injector to inject the proper amount of fuel into the associated cylinder;

generating a pulse for idle and low load operation with two steps, the first step being about the same amplitude as the first step in the normal operation pulse but having a shorter duration and a second step being about the same amplitude as the second step of the normal operation pulse and having a duration sufficient to hold the armature adjacent the stator and the first seat of the flow regulating device open to allow the injector to inject the proper amount of fuel into the associated cylinder, whereby the seating velocity and impact on the second seat of the flow regulating device is reduced reducing the seating noise and wear on the second seat.

8. The method of controlling hydraulically actuated electrically controlled unit fuel injectors as set forth in claim 7, wherein the step of varying the timing, duration and amplitude of the pulse comprises generating a spike having an amplitude sufficient to slow down the armature and flow regulating device just before seating the first seat, the spike being timed after the second step, whereby the velocity just prior to seating and the impact on the seat are reduced, reducing noise and wear on the first seat.

9. The method of controlling hydraulically actuated electrically controlled unit fuel injectors as set forth in claim 2, wherein the step of varying the timing, duration and amplitude of the pulse, comprises:

generating a pulse for normal operation with two steps, the first step having a current of sufficient amplitude and duration to draw the armature rapidly to the stator and to operate the flow regulating device and a second step having a current lower in amplitude then the current of the first step and of sufficient amplitude to hold the armature adjacent the stator and the first seat of the flow regulating device open and having a duration sufficient to allow the injector to inject the proper amount of fuel into the associated cylinder; and generating a pulse for idle and low load operation with one step, the step having an amplitude substantially less than the amplitude of the first step in the normal operation pulse and the duration of the step is about the same as the combined duration of the first and the second step of the normal operation pulse, whereby the seating force on the upper seat of the flow regulating device is reduced reducing the seating noise and wear on the second seat.

10. The method of controlling hydraulically actuated electrically controlled unit fuel injectors as set forth in claim 9, wherein the step of varying the timing, duration and amplitude of the pulse comprises generating a spike having a short duration and a current amplitude duration sufficient to slow down the armature and flow regulating device just before seating the first seat, the spike being timed after the pulse, whereby the velocity and impact on the first seat are reduced, reducing noise and wear on the first seat.

11. The method of controlling hydraulically actuated electrically controlled unit fuel injectors as set forth in claim 1, wherein the flow regulating device is a poppet valve.

* * * * *